US005242749A

United States Patent [19]

Bayly et al.

[11] Patent Number: 5,242,749

[45] Date of Patent: Sep. 7, 1993

[54] FIBRE REINFORCED PLASTICS STRUCTURES

[75] Inventors: Andrew E. Bayly, Beaconsfield; Ian S. Biggs, High Wycombe; Bronislaw Radvan, Flackwell Heath, all of England

[73] Assignee: The Wiggins Teape Group Limited, Basingstoke, England

[21] Appl. No.: 563,714

[22] Filed: Aug. 7, 1990

Related U.S. Application Data

[62] Division of Ser. No. 167,100, Mar. 11, 1988, Pat. No. 4,981,636.

[30] Foreign Application Priority Data

Mar. 13, 1987 [JP] Japan ..... 62-05954

[51] Int. Cl.[5] ..... B32B 5/16

[52] U.S. Cl. ..... 428/283; 162/145; 162/146; 162/156; 162/164.1; 428/288; 428/296; 428/297; 428/323; 428/903

[58] Field of Search ..... 428/283, 323, 327, 288, 428/296, 297, 903; 162/145, 146, 156, 164.1

[56] References Cited

U.S. PATENT DOCUMENTS

| | | | |
|---|---|---|---|
| B1 4,543,288 | 1/1988 | Radvan et al. | 418/297 |
| 1,875,018 | 8/1932 | Kliefoth . | |
| 1,901,382 | 3/1933 | Stevenson . | |
| 2,388,187 | 10/1945 | Salle . | |
| 2,653,870 | 9/1953 | Kast . | |
| 2,715,755 | 8/1955 | Jones | 264/121 |
| 2,795,524 | 6/1957 | Rodman | 264/121 |
| 2,892,107 | 6/1959 | Williams et al. | 310/8 |
| 2,962,414 | 11/1960 | Arledter | 162/145 |
| 3,042,574 | 7/1962 | Hochberg | 156/286 |
| 3,200,181 | 8/1965 | Rudloff | 264/109 |
| 3,216,841 | 11/1965 | Thellmann | 106/208 |
| 3,396,062 | 8/1968 | White | 156/244 |
| 3,428,518 | 2/1969 | Schafer | 161/170 |
| 3,452,128 | 6/1969 | Rains | 264/126 |
| 3,489,827 | 1/1970 | Mueller et al. | 264/50 |
| 3,494,824 | 2/1970 | Roberts | 162/152 |
| 3,573,158 | 3/1971 | Pall et al. | 162/131 |
| 3,607,500 | 9/1971 | Field | 264/119 |
| 3,621,092 | 11/1971 | Hofer | 264/120 |
| 3,734,985 | 5/1973 | Greenberg | 264/45 |
| 3,832,115 | 8/1974 | Ettel | 425/373 |
| 3,837,986 | 9/1974 | Gorter et al. | 161/59 |
| 3,850,723 | 11/1974 | Ackley | 156/180 |
| 3,856,614 | 12/1974 | Susuki et al. | 161/159 |
| 3,865,661 | 2/1975 | Hata et al. | 156/79 |
| 3,873,336 | 3/1975 | Lambert et al. | 106/306 |
| 3,897,533 | 7/1975 | Hani et al. | 264/137 |
| 3,903,343 | 9/1975 | Pfaff | 428/168 |
| 3,930,917 | 1/1976 | Esakov et al. | 156/78 |
| 3,975,483 | 8/1976 | Rudloff | 264/137 |
| 3,980,511 | 9/1976 | Proucelle | 156/62.4 |
| 3,980,613 | 9/1976 | Bachot et al. | 264/45.3 |
| 3,981,738 | 6/1975 | Shen | 264/120 |
| 4,007,083 | 2/1977 | Ring et al. | 162/101 |
| 4,044,188 | 8/1977 | Segal | 428/283 |

(List continued on next page.)

FOREIGN PATENT DOCUMENTS

| | | |
|---|---|---|
| 230504 | 1/1958 | Australia . |
| 559853 | 7/1983 | Australia . |

(List continued on next page.)

OTHER PUBLICATIONS

1004 Abstracts Bulletin of the Institute of Paper Chemistry, vol. 53 (1982) Aug. No. 2, Appleton, Wisconsin, USA.

(List continued on next page.)

*Primary Examiner*—James J. Bell

*Attorney, Agent, or Firm*—Burns, Doane, Swecker & Mathis

[57] ABSTRACT

An air permeable sheet-like structure comprising 5% to 50% by weight of reinforcing fibres, and between about 5 and about 50 millimeters long, and from 50% to 95% by weight of wholly or substantially unconsolidated particulate non-cross-linked elastomeric material, and in which the fibrous and elastomeric components are bonded into an air permeable structure.

12 Claims, 2 Drawing Sheets

U.S. PATENT DOCUMENTS

Figure 2:
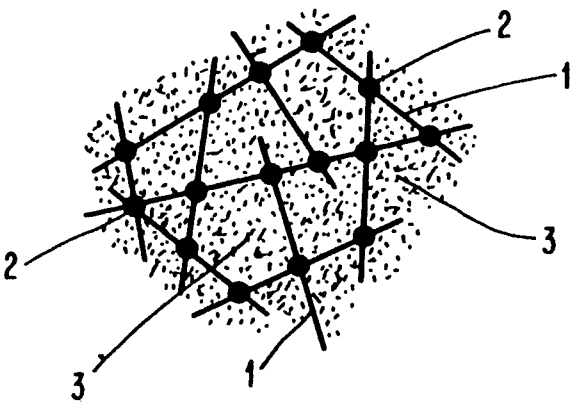

| | | | |
|---|---|---|---|
| 4,081,318 | 3/1978 | Wietsma | 162/157 R |
| 4,104,340 | 8/1978 | Ward | 264/6 |
| 4,104,435 | 8/1978 | Ballesteros | 428/288 |
| 4,153,760 | 5/1979 | Sundberg et al. | 429/252 |
| 4,159,294 | 6/1979 | Oishi et al. | 264/45.3 |
| 4,178,411 | 12/1979 | Cole et al. | 428/310 |
| 4,234,652 | 11/1980 | Vanoni et al. | 428/296 |
| 4,242,404 | 12/1980 | Bondoc et al. | 428/220 |
| 4,273,981 | 6/1981 | Nopper | 264/120 |
| 4,286,977 | 9/1981 | Klein | 55/524 |
| 4,327,164 | 4/1982 | Feinberg et al. | 429/144 |
| 4,339,490 | 7/1982 | Yoshioka et al. | 428/213 |
| 4,359,132 | 11/1982 | Parker et al. | 181/169 |
| 4,362,778 | 12/1982 | Andersson et al. | 428/240 |
| 4,386,943 | 6/1983 | Gumbel et al. | 51/298 |
| 4,393,154 | 7/1983 | Tyler et al. | 524/12 |
| 4,399,085 | 8/1983 | Belbin et al. | 264/41 |
| 4,426,470 | 1/1984 | Wessling et al. | 524/35 |
| 4,440,819 | 4/1984 | Rosser et al. | 428/107 |
| 4,451,539 | 5/1984 | Vallee et al. | 428/515 |
| 4,469,543 | 9/1984 | Segal et al. | 156/283 |
| 4,481,248 | 11/1984 | Fraige | 428/283 |
| 4,495,238 | 1/1985 | Adiletta | 428/215 |
| 4,498,957 | 2/1985 | Sasaki et al. | 162/146 |
| 4,503,116 | 3/1985 | Lapidus | 428/286 |
| 4,508,777 | 4/1985 | Yamamoto et al. | 428/280 |
| 4,512,836 | 4/1985 | Tucci | 156/174 |
| 4,543,288 | 9/1985 | Radvan et al. | 428/297 |
| 4,555,426 | 11/1985 | Roth et al. | 428/113 |
| 4,562,033 | 12/1985 | Johnson et al. | 264/510 |
| 4,568,581 | 2/1986 | Peoples, Jr. | 428/35 |
| 4,595,617 | 6/1986 | Bogdany | 428/95 |
| 4,643,940 | 2/1987 | Shaw et al. | 428/308.4 |
| 4,649,014 | 3/1987 | Tochikawa | 264/555 |
| 4,659,528 | 4/1987 | Plowman et al. | 264/49 |
| 4,670,331 | 6/1987 | Radvan et al. | 428/303 |
| 4,690,860 | 9/1987 | Radvan et al. | 428/290 |
| 4,719,039 | 1/1988 | Leonardi | 252/511 |
| 4,734,321 | 3/1988 | Radvan et al. | 428/283 |
| 4,773,225 | 5/1987 | Farley et al. | 428/290 |
| 4,882,114 | 11/1989 | Radvan et al. | 264/129 |

FOREIGN PATENT DOCUMENT

| | | |
|---|---|---|
| 0071219 | 2/1983 | European Pat. Off. . |
| 0148760 | 7/1985 | European Pat. Off. . |
| 0148763 | 7/1985 | European Pat. Off. . |
| 0152994 | 8/1985 | European Pat. Off. . |
| 0173382 | 3/1986 | European Pat. Off. . |
| 24181Q | 1/1963 | Fed. Rep. of Germany . |
| 3420195 | 12/1985 | Fed. Rep. of Germany . |
| 1040359 | 10/1953 | France . |
| 1553537 | 2/1967 | France . |
| 1529133 | 6/1968 | France . |
| 2083560 | 12/1971 | France . |
| 2289338 | 5/1976 | France . |
| 2475970 | 8/1981 | France . |
| 56-37373 | 4/1981 | Japan . |
| 462024 | 10/1968 | Switzerland . |
| 448138 | 6/1936 | United Kingdom . |
| 703023 | 1/1954 | United Kingdom . |
| 729381 | 5/1955 | United Kingdom . |
| 843154 | 8/1960 | United Kingdom . |
| 855132 | 11/1960 | United Kingdom . |
| 871117 | 6/1961 | United Kingdom . |
| 1008833 | 11/1965 | United Kingdom . |
| 1058932 | 2/1967 | United Kingdom . |
| 1110659 | 4/1968 | United Kingdom . |
| 1113792 | 5/1968 | United Kingdom . |
| 1129757 | 10/1968 | United Kingdom . |
| 1133606 | 11/1968 | United Kingdom . |
| 1134785 | 11/1968 | United Kingdom . |
| 1198324 | 7/1970 | United Kingdom . |
| 1204039 | 9/1970 | United Kingdom . |
| 1230789 | 5/1971 | United Kingdom . |
| 1231937 | 5/1971 | United Kingdom . |
| 1263812 | 2/1972 | United Kingdom . |
| 1305982 | 2/1973 | United Kingdom . |
| 1306145 | 2/1973 | United Kingdom . |
| 1329409 | 9/1973 | United Kingdom . |
| 1330485 | 9/1973 | United Kingdom . |
| 1348896 | 3/1974 | United Kingdom . |
| 1353477 | 5/1974 | United Kingdom . |
| 1373782 | 11/1974 | United Kingdom . |
| 1412642 | 11/1975 | United Kingdom . |
| 1424682 | 2/1976 | United Kingdom . |
| 1519310 | 7/1978 | United Kingdom . |
| 2051170 | 1/1981 | United Kingdom . |
| 2065016 | 6/1981 | United Kingdom . |
| 2093474 | 9/1982 | United Kingdom . |
| 2096195 | 10/1982 | United Kingdom . |

OTHER PUBLICATIONS

"Polymer Processing", James M. McKelvey, 1962.

"Fibre Foam", Turner & Cogswell, 1976, presented at VIIth International Congress on Rheology in Sweden, Aug. 23–Aug. 27, 1976.

"Paints and varnishes–Determination of flow time by use of flow cups", International Standard ISO 2431, 1984.

"Part A6, Determination of flow time by use of flow cups", British Standards Institution, 1984.

Kunststoffe, vol. 75, No. 8, Aug. 1985, pp. 497–503.

FIBRE REINFORCED PLASTICS STRUCTURES

This application is a division of application Ser. No. 07/167,100, filed Mar. 11, 1988, now U.S. Pat. No. 4,981,636.

This invention relates to sheet-like fibrous structures, and in particular to such structures for use in the production of fibre reinforced rubber or rubber-like materials or articles. The invention also relates to a process for making such materials.

Fibre reinforced rubber articles are known, and are usually by laminating fabrics with sheets of unvulcanised or thermoplastic rubber, impregnating fabric with latex, followed by coagulation, or incorporating very short fibres in the rubber mix during compounding.

Sheets produced by the first two methods cannot be easily formed into complex shapes, whilst the third method gives only poor reinforcement, because the short fibres become even further comminuted in length during compounding.

It is among the objects of the present invention to provide a composite fibre and rubber or rubber like material for use in the moulding of fibres reinforced articles which overcomes or alleviates the disadvantages of known methods and materials described above.

According to the present invention an air permeable sheet-like structure comprises 5% to 50% by weight of reinforcing fibres, and between about 5 and about 50 millimeters long, and from 50% to 95% by weight of wholly or substantially unconsolidated particulate non-cross-linked elastomeric material and in which the fibrous and elastomeric components are bonded into an air permeable structure. The permeable structure may optionally then be consolidated. It has been found that beneficial effects can be obtained, such as a doubling in tear strength with as little as 6% by weight of reinforcing fibres compared with an unreinforced sheet.

Preferably, the fibres are in the form of single discrete fibres. Thus, where glass fibres are used, and are received in the form of chopped strand bundles, the bundles are broken down into single fibres before the structure is formed.

Other reinforcing fibres may be selected from the extensive range known by those skilled in the art of fibre reinforcement as imparting benefit, for example Nylon, Polyester, Viscose and fibres such as the aramid fibres sold under the trade names Kevlar and Nomex. Fillers may also be incorporated in the sheet either for economy or to impart particular characteristics.

Particulate non-cross-linked elastomeric material is to be taken as including natural rubber, synthetic rubbers such as nitrile rubber, styrene butadiene rubber and elastomers which are also thermoplastic, for example, certain styrene block copolymers, polyolefin blends, polyeurethanes and copolyesters.

Bonding may be effected by utilizing such thermal characteristics as the elastomeric material possesses. With the structure being heated sufficiently to cause the elastomeric component to fuse at its surfaces to adjacent particles and fibres. Care must be taken however to ensure that the conditions of heating are not such as to cause thermal degradation of the elastomeric material or vulcanisation of rubber.

Alternatively, a binder inert to the elastomeric material may be added during manufacture of the structure to effect bonding. Any such binder may be used which will effect a bond at a lower temperature than that which would result in consolidation of the elastomeric material within the structure. Suitable binders include carboxymethyl cellulose and starch.

Individual fibres should not be shorter than about 5 millimeters, since shorter fibres do not provide adequate reinforcement in the article ultimately to be moulded from the product of the invention. Nor should they be longer than 50 millimeters since such fibres are difficult to handle in the preferred manufacturing process for the fibrous structure.

Preferably glass fibres are 13 microns in diameter or less. Glass fibre of diameters greater than 13 microns will not so efficiently reinforce the plastics matrix after moulding though textile fibres are not so restricted.

Preferably, the elastomeric material is in a particulate form. Although the powders need not be excessively fine, particles coarser than about 1.5 millimeters, as exemplified by coarse sand or fine rice grains, are unsatisfactory in that they do not flow sufficiently during the moulding process to produce a homogeneous structure.

Because the structure is permeable, it is capable of being preheated by hot air permeation. This technique permits rapid homogeneous heating of the whole structure in a manner which is impossible to achieve with laminated fabric and rubber sheets.

Preferably, the degree of bonding is controlled to cohere the components whilst still retaining sufficient flexibility to permit the structure to be reeled. In the reeled condition, it can be transported readily for use by a moulder in a continuous preheating and moulding process. Alternatively, and to minimize material wastage, shaped elements may be cut, pressed or stamped from the structure and supplied to the mould I in a form permitting articles to be moulded with minimum flash to be removed and disposed of. The residual material may be recycled through the forming process, and neither the moulder nor the manufacturer of the fibrous structure will be faced with the need to dispose of waste material.

If a rubber is used it can be vulcanised after moulding if desired.

Alternatively, the degree of bonding may be such as to produce a rigid, but still air permeable sheet where this will meet the moulder's requirements. This is effected by adjusting the degree of fusion of the elastomer when it is also a thermoplastic, or the amount of binder added to achieve the desired effect, the adjustment depending on the kinds of elastomer or binder used.

In another aspect, the invention provides a process for the manufacture of a permeable sheet-like fibrous structure, which includes forming a web with 5% to 50% of single fibres between 5 and 50 millimeters long, and 50% to 95% by weight of a wholly or substantially unconsolidated particulate non-cross-linked elastomeric material, and then treating the web to bond the fibres and elastomeric material together.

Preferably, the web is formed by the process described in UK Patents Nos. 1129757 and 1329409, which relate to methods of producing fibrous sheets on papermaking machinery. This process achieves a very uniform distribution of single fibres in the sheet, even when the fibres are much longer than can be handled in conventional papermaking machinery.

However, other web forming techniques may be used in certain circumstances. Thus, for example, such a structure may be formed by using a very low consistency dispersion of fibres and elastomeric powder, together with a binder, and forming the structure of a paper machine with an "uphill wire". Alternatively, the web may be formed with the aid of a Rotiformer (Registered Trade Mark).

The web of fibres and elastomeric powder may also be formed using a dry laying technique as described in UK Patent No. 1424682. In this case, the binder may be applied by means of a spray or by dipping and draining the web after it has been formed.

In all cases however, after the web has been formed it is treated, by the addition of a binderor possibly by heating in the case of a web containing thermoplastic elastomers, to effect bonding without substantially consolidating the elastomeric particles held in the web. Slight metering may be effected to ensure that the structure produced has a constant thickness. However, pressure and temperature conditions must be less than those which would compact the web.

Optionally, where a customer is only equipped to handle consolidated sheets, and the elastomeric content of the fibrous structure is wholly of an elastomeric material which is also thermoplastic, the structure may be cut into required lengths, after which it is subjected to heating and cooling under pressure to effect consolidation.

Figure 1:
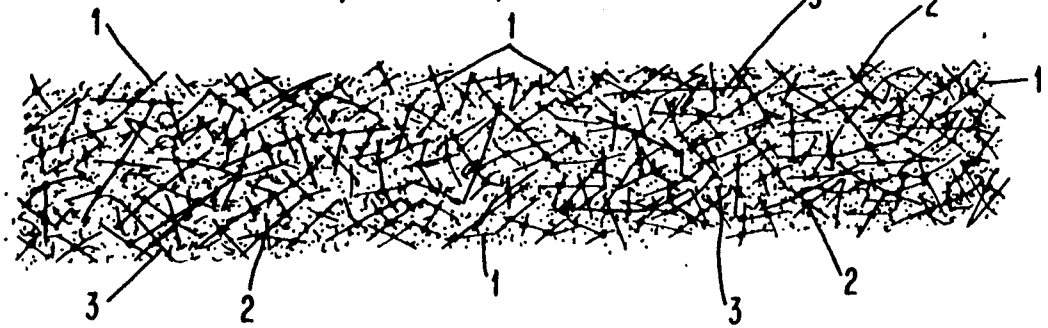
Figure 3:
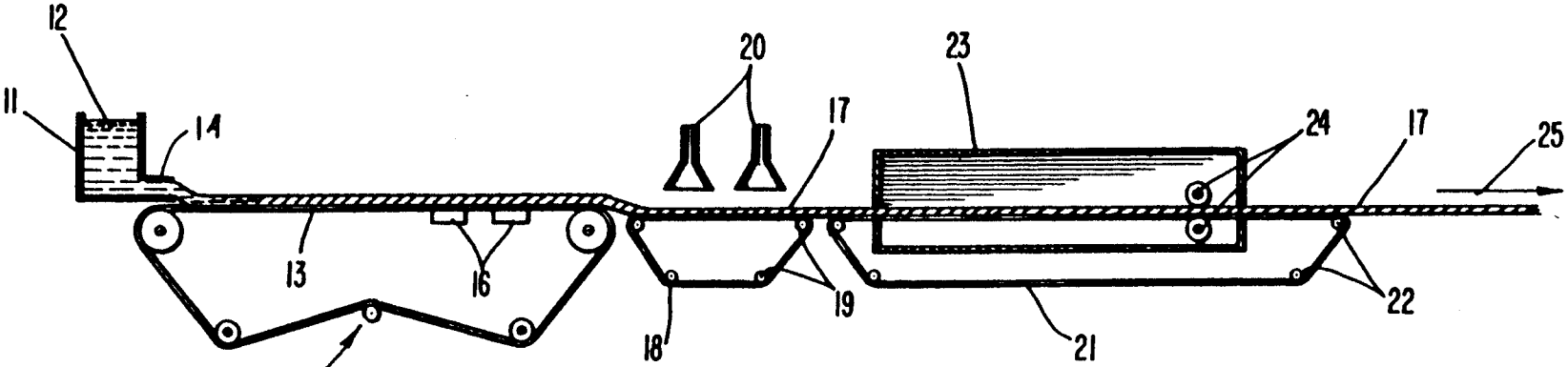
Figure 4:
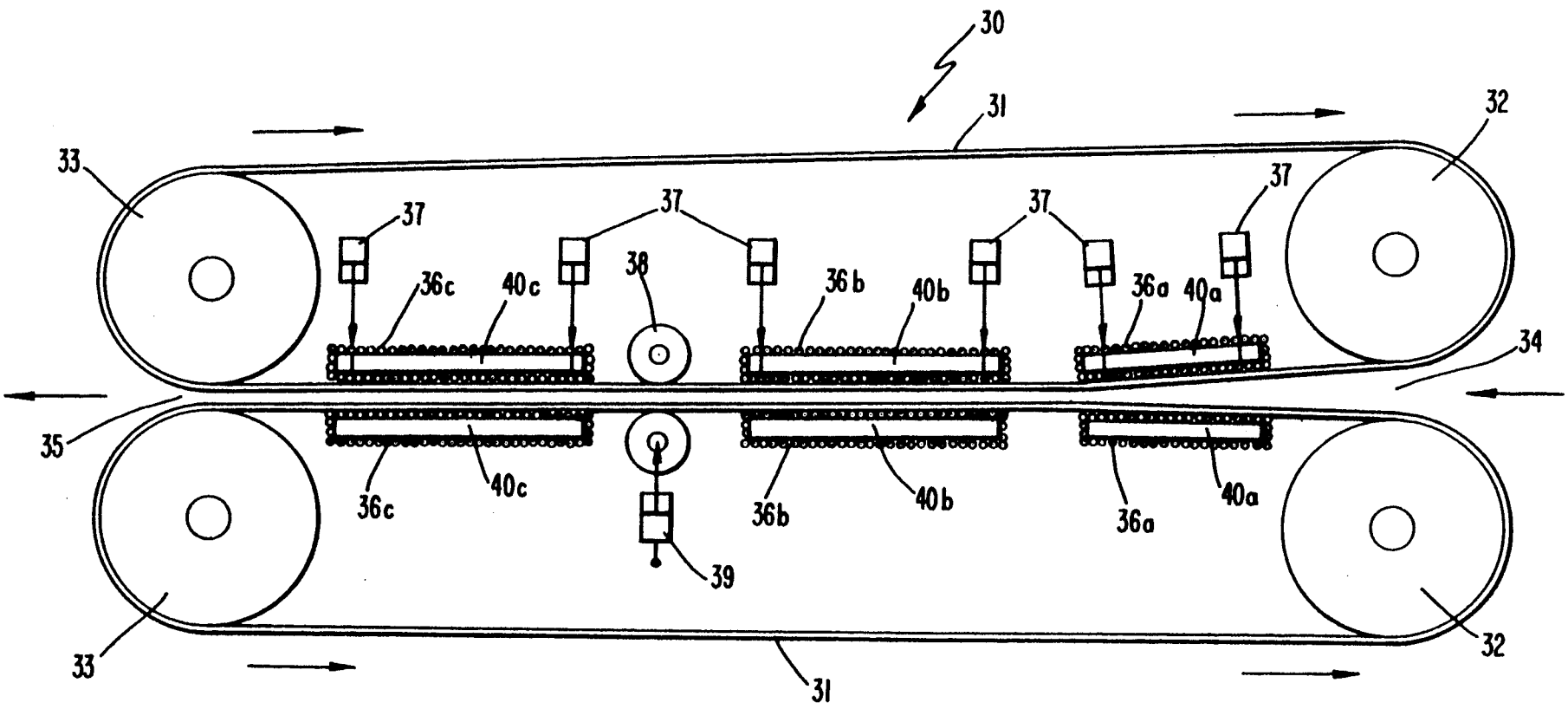

The invention will now be further described with reference to the accompanying drawings in which:

FIG. 1 is a diagrammatic cross-section of part of a fibrous structure according to the invention, FIG. 2 is a diagrammatic microscopic view of part of the fibrous structure of FIG. 1, FIG. 3 is a diagrammatic side elevation of an apparatus for carrying out the preferred process of the invention, and FIG. 4 is a diagrammatic side elevation of an apparatus for optionally carrying out an additional process step.

Referring first to FIGS. 1 and 2, this shows an uncompacted fibrous structure comprising fibres 1 bonded together at their points of intersection 2 by a binder so as to form a skeletal structure within the interstices of which a particulate elastomeric like material 3 is also retained by the binder.

Typically, the fibres are glass fibres 12 millimeters long and 11 microns in diameter, the binder is starch and the elastomeric material is a particulate elastomer.

Referring to FIG. 3, this shows an apparatus for making a fibrous structure according to the preferred method of the invention. There is shown at 10, the wet end of a Fourdrinier type papermaking machine including a headbox 11 which contains a dispersion 12. The dispersion 12 consists of glass fibres and particulate elastomeric particles in a foamed aqueous medium. A suitable foaming agent consists of sodium dodecylbenzene sulphate at a concentration of 0.8% in water.

After drainage on the Fourdrinier wire 13 with the aid of suction boxes 16, a web 17 is formed of unbonded glass fibres interspersed with the elastomeric particles. This is carefully transferred from the Fourdrinier wire 13 to a short endless wire mesh belt 18 tensioned around rollers 19. The belt 18 carries the web 17 under sprays 20 which apply liquid binder. Optionally, the binder may be applied by means of a curtain coater of known design. The web is then transferred to an endless travelling band 21 of stainless steel tensioned around rollers 22 and which carries the web through a drying tunnel 23. This causes residual moisture to be driven off and the binder to bond the fibres together. Towards the end of the drying tunnel, the web 17 is taken through a pair of rolls 24, whose function is to contol or meter the thickness of the resulting fibrous structure without applying pressure. The resulting sheet material is then taken in the direction of the arrow 25 for reeling.

Means for consolidating the material produced as described above are shown in FIG. 4 and can be used when the elastomeric component is also thermoplastic. FIG. 4 shows a continuous hot press of the steel band type (Sandvik Conveyors Ltd.) which may be employed to consolidate material received directly from the rolls 24 or unconsolidated material which has previously been reeled. The press is shown at 30 in FIG. 4 wherein a pair of travelling endless steel bands 31 are each retained around a pair of rotating drums 32 and 33. The separation between the pair of bands 31 decreases from the inlet 34 to the outlet 35 and defines a passage, through which the web (not shown) is conveyed from right to left. Between drums 32 and 33 there are provided six sheets of roller chains **36*a*, 36*b* and 36*c* arranged in pairs on opposite sides of the passage adjacent the bands 31. The lower sets of chains 36*a*, 36*b* and 36*c* are fixed but the upper sets are reciprocally mounted and connected to hydraulic rams 37. In this way, each pair of chains 36*a*, 36*b* and 36*c* serves to guide and maintain the bands 31 in position and also to consolidate the web whilst being conveyed through the passage. Between chains 36*b* and 36*c*, there are provided two nip rolls 38 which are disposed on opposite sides of the passage adjacent the bands 31; the lower roll being supported by a hydraulic jack 39. These rolls 38 further assist in the consolidation of the web. Within the sets of chains 36*a* and 36*b* are heating platens 40*a* and 40*b* which heat the bands 31 and in turn the web whilst cooling platens 40*c* are disposed within the set of chains 36*c***.

Further advantages of the present invention will become apparent from the following examples.

EXAMPLE 1

Two sheets were separately made by the following method using a froth flotation cell (Denver Equipment Co.) as described in U.K. Patents Nos. 1129757 and 1329409 a foamed dispersion was formed in 7 liters of water and 15 cubic centimeters of a foaming agent (sodium dodecyl benzene sulphonate) of the materials listed below, the cell being operated for approximately 1½ minutes to produce a dispersion containing approximately 67% air.

The materials added to the dispersion were 100 grammes of single flass fibres 11 microns in diameter and 12 millimeters long 288 grammes of a polyester elastomer having thermoplastic properties and sold under the trade name HYTREL 5556 by Du Pont 9 grammes of an antioxidant sold under the trade name IRGAFOS 168

3 grammes of an antioxidant sold under the trade name NORGUARD 445

Prior to addition to the froth flotation cell the antioxidants were mixed with the polyester elastomer in a food mixer.

The foamed dispersion was transferred to a standard laboratory sheet making apparatus and drained, the resulting web being then dried at 110° C. for 4 hours in an oven.

The two webs formed by the foregoing method were then placed together between clean plates of polytetrafluoroethylnene in a hot platen press with a thermocouple located between the webs. Pressure was then applied until a temperature of 220° C. was attained. Pressure was then increased slightly until the elastomer began to flow slightly from between the plates. Heat was then removed and coolant applied to the press. After cooling the resulting two ply sheet was removed from the press and tested.

EXAMPLE 2

The procedure described in Example 1 was repeated except that a three ply sheet was formed, the components of the three plies being as follows:

1. 100 grammes of single glass fibres 11 microns in diameter and 12 millimeters long.
2. 240 grammes of a thermoplastic polyester sold under the trade name VALOX 315 by General Electric Co.
3. 58 grammes of a polyester elastomer having thermoplastic properties and sold under the trade name HYTREL 5556 by Du Pont.

1 gram of an antioxidant sold under the trade name IRGAFOS 68.

1 gram of an antioxidant sold under the trade name NORGUARD 445.

Prior to addition to the froth flotation cell, the antioxidants were mixed with the polyester elastomer in a food mixer.

EXAMPLE 3

The procedure described in Example 1 was repeated but with polyesto fibre having a denier of 3.3 and a length of 12 millimeters in place of glass fibre.

The results of the tests on the samples produced from Examples 1,2 and 3 are shown in Table 1.

TABLE 1

| | | Physical Properties of Fibre Reinforced Hytrel | | | | | | | |
|---|---|---|---|---|---|---|---|---|---|
| | | | | IMPACT TEST | | | | | |
| Example | Composition | Flexural Modulus MPA | Peak Flexural Strength MPA | Peak Energy J | Fail Energy J | Peak Force N | Ultimate Tensile Strength Notched MPA | Ultimate Tensile Strength Notched MPA | % Elongation of fracture |
| 1 | 25% by weight glass 75% by weight Hytrel | 2830 (440) | 77 (5.3) | 2.1 | 9.3 | 1030 | 61 (5.1) | 70 (3.9) | 3.4 (0.1) |
| 2 | 25% by weight glass 60% by weight Valox 315 15% by weight Hytrel | 4780 (300) | 142 (79) | 3.1 | 8.1 | 980 | 86 (8.5) | 125 (38) | 3.7 (1.3) |
| 3 | 25% by weight polyester fibre 75% by weight Hytrel | | | 13 | 19 | 2920 | 47 (4.4) | 55 (4.4) | 43 (7.8) |

Standard deviation is given in brackets after the figure it is referring to

In the following Examples the procedure of Example 1 was followed but with the press temperature at 200° C. and the other variations as set out .

EXAMPLE 4

A two ply sheet was formed in which each ply contained in place of the components specified in Example 1

1. 50 grammes of polyester fibre denier 1.7 and 12 millimeters long
2. 150 grammes of a halogenated polyolefin elastomer having thermoplastic properties and sold under the trade name ALCRYN R 1201-60A.

EXAMPLE 5

A two ply sheet was formed as described in Example 4 but in which 100 grammes of ALCRYN was substituted by 100 grammes of polypropylene provided in each ply.

EXAMPLE 6

A two ply sheet was formed as described in Example 1, but in which the first ply contained 150 grammes of polypropylene powder in lieu of HYTREL and the second ply contained 150 grammes of ALCRYN in lieu of HYTREL.

The sheets produced by Examples 4, 5 and 6 were tested and the results are set out in Table 2.

TABLE 2

| | | | Impact Test | | | Ultimate Tensile Strength | | | | |
|---|---|---|---|---|---|---|---|---|---|---|
| Example | | Flexural Modulus MPa | Peak Energy J | Fail Energy J | Peak Force N | Notched MPa | Unnotched MPa | % Elongation On Fracture | Tear Strength N | Youngs Modulus MPa |
| 5 | | 2820 | 3.8 | 15.4 | 1550 | | | | | |
| 6A | Alcryn side up | 1540 | 5.9 | 18.4 | 1560 | | | | | |
| 6B | Polypropylene side up | 1590 | 5.1 | 13.2 | 149 | | | | | |
| 4 | | | | | | 16 | 15 | 6 | 86 | 570 |

EXAMPLE 7

Using the equipment and general procedure described in Example 1 sheets were made containing a range of reinforcing fibres with various thermoplastic elastomers in powder form. Details and results are shown in Table 3.

EXAMPLE 8

Using the equipment and general procedure described in Example 1 sheets were made containing reinforcing fibres in powdered rubbers. Prior to powdering the rubbers had been compounded with proprietary vulcanising/delayed action cure agents. Details of these sheets and results are shown in Table 4.

TABLE 3

| Fibre reinforced thermoplastic elastomer sheets after consolidation | | | | | | | | | | |
|---|---|---|---|---|---|---|---|---|---|---|
| | | Santoprene 201-55 | | | Alcryn R1201 | | Desmopan 786 | | Desmopan 150 | |
| Thermoplastic Elastomer | | | 5% vol | 10% vol | | 16% vol | | 5% vol | | 10% vol |
| Reinforcing fibre | | None | 6 mm Kevlar | 18 mm, 1.7 dt Polyester | None | 6 mm, 3 d Nylon | None | 6 mm Kevlar | None | 13 mm, 11μ Glass |
| Sheet Grammage | (g/m) | — | 1607 | 1233 | — | 1847 | — | 1746 | — | 1754 |
| DIN Tear | (N/mm) | 7 | 29 | 15 | 15 | 78 | 55 | 114 | 102 | 163 |
| Tensile strength | (MPa) | 4.2 | 4.0 | 2.3 | 8 | 13 | 9 | 33 | 15 | 28 |
| Elongation at break | (%) | 430 | 292 | 180 | 568 | 39 | 450 | 12 | 400 | 15 |
| Shore Hardness | (A) | 55 | — | 83 | 55 | 83 | — | — | 96 | 96 |
| | (D) | 9 | — | 19 | 12 | 30 | — | — | 53 | 60 |

Santoprene-"Thermoplastic Rubber" from Monsanto
Alcryn-Thermoplastic Polyolefin elastomer from Dupont
Desmopan-Thermoplastic Polyurethane elastomer from Bayer

TABLE 4

| Fibre reinforced rubber sheets after consolidation and vulcanisation | | | | | | | |
|---|---|---|---|---|---|---|---|
| | | Natural Rubber | | | Styrene Butadiene Rubber | | |
| Rubber type | | | 10% vol | 4.5% vol | | 10% vol | 4.5% vol |
| Fibre Reinforcement | | None | 10 mm, 3 d Nylon | 13 mm, 11μ Glass | None | 10 mm, 3 d Nylon | 13 mm, 11μ Glass |
| Mean Tensile Strength | (MPa) | 6.6 | 13.2 | 10.0 | 3.0 | 14.7 | 9.0 |
| Mean Elongation at break | (%) | 733 | 36 | 8 | 740 | 36 | 4 |

We claim:

1. A mouldable air permeable sheet-like fibrous structure which consists essentially of a web with 5% to 50% of a single discrete reinforcing fibres between 5 and 50 millimeters long and from 50% to 95% by weight of a wholly or substantially unconsolidated particulate non-cross-linked elastomeric material having a particle size of less than about 1.5 millimeters, wherein the fibres and the elastomeric material are bonded together, said elastomeric material remaining in a particulate form.

2. A mouldable air permeable sheet-like fibrous structure as claimed in claim 1 in which the particulate elastomeric material is natural rubber, synthetic rubber or styrene butadiene rubber.

3. A mouldable air permeable sheet-like fibrous structure as claimed in claim 1 in which the elastomeric material is thermoplastic.

4. A mouldable air permeable sheet-like fibrous structure as claimed in claim 3 in which the elastomeric material is selected from the group consisting styrene block copolymers, polyolefin blends, polyurethanes and copolyesters.

5. A mouldable air permeable sheet-like fibrous structure as claimed in claim 3 which has been consolidated by heat and pressure to make it substantially impermeable.

6. A mouldable air permeable sheet-like fibrous structure as claimed in claim 3 in which the fibres and particulate thermoplastic elastomeric material have been bonded together by heating.

7. A mouldable air permeable sheet-like fibrous structure as claimed in claim 1 in which a binder is included to provide bonding.

8. A mouldable air permeable sheet-like fibrous structure as claimed in claim 7 in which the binder is selected from the group consisting of carboxymethyl cellulose of starch.

9. A mouldable air permeable sheet-like fibrous structure as claimed in claim 1 in which the diameter of the fibres is not more than 13 microns.

10. A mouldable air permeable sheet-like fibrous structure as claimed in claim 1 which is flexible and reelable.

11. A mouldable air permeable sheet-like fibrous structure as claimed in claim 1 in which the web has been formed on a paper making machine from an aqueous dispersion of the fibres and particulate elastomeric material.

12. A mouldable sheet-like fibrous structure which consists essentially of a web with 5% to 50% of single discrete reinforcing fibres between 5 and 50 millimeters long, and from 50% to 95% by weight of a wholly or substantially unconsolidated particulate non-cross-linked elastomeric material having a particle size of less than about 1.5 millimeters, the elastomeric material being thermoplastic, the fibres and the elastomeric material being bonded together with the elastomeric material remaining in a particulate form, and consolidated by heat and pressure to make the sheet impermeable.

* * * * *